US005803704A

United States Patent [19]

Lazzarotti

[11] Patent Number: 5,803,704

[45] Date of Patent: Sep. 8, 1998

[54] APPARATUS AND METHOD FOR ACCUMULATING AND TRANSFERRING ONE OR MORE STACKS OF ARTICLES

[75] Inventor: S. James Lazzarotti, Broomall, Pa.

[73] Assignee: Lockheed Martin Corporation, Bethesda, Md.

[21] Appl. No.: 190,808

[22] Filed: Feb. 1, 1994

[51] Int. Cl.[6] ..... B65H 29/26

[52] U.S. Cl. ..... 414/793.4; 414/218; 414/926

[58] Field of Search ..... 414/794.4, 926, 414/793.4, 793.5, 794.3; 271/217, 218, 213

[56] References Cited

U.S. PATENT DOCUMENTS

| | | | |
|---|---|---|---|
| 3,285,607 | 11/1966 | Lindemann | 271/218 |
| 3,674,143 | 7/1972 | Hunter et al. . | |
| 3,779,546 | 12/1973 | Wojtowicz et al. . | |
| 3,782,541 | 1/1974 | Wood . | |
| 3,806,115 | 4/1974 | Wojtowicz et al. . | |
| 3,814,415 | 6/1974 | Hunter et al. . | |
| 3,817,516 | 6/1974 | Lazzarotti et al. . | |
| 3,847,383 | 11/1974 | Wojtowicz et al. . | |
| 3,884,370 | 5/1975 | Bradshaw et al. . | |
| 3,927,876 | 12/1975 | Wojtowicz et al. . | |
| 3,960,374 | 6/1976 | Gaffney | 271/218 |
| 4,043,458 | 8/1977 | Schott | 271/218 |
| 4,136,780 | 1/1979 | Hunter et al. . | |
| 4,149,622 | 4/1979 | Bradshaw et al. . | |
| 4,150,743 | 4/1979 | Lazzarotti et al. . | |
| 4,161,244 | 7/1979 | Hunter et al. . | |
| 4,307,293 | 12/1981 | Lazzarotti et al. . | |
| 4,318,539 | 3/1982 | Lamos | 271/217 |
| 4,350,333 | 9/1982 | Landa | 271/217 |
| 4,452,442 | 6/1984 | Geschwindmer et al. | 271/218 |
| 4,482,059 | 11/1984 | Horii et al. . | |
| 4,601,394 | 7/1986 | Hutner . | |
| 4,606,660 | 8/1986 | Bradshaw et al. . | |
| 4,750,729 | 6/1988 | Kanoto et al. | 271/217 |
| 4,966,521 | 10/1990 | Frye et al. | 414/794.4 |
| 5,050,743 | 9/1991 | Lazzarotti . | |
| 5,069,440 | 12/1991 | Lazzarotti et al. . | |
| 5,097,960 | 3/1992 | Tilles et al. . | |
| 5,109,987 | 5/1992 | Daboub et al. . | |
| 5,174,454 | 12/1992 | Parkander . | |

FOREIGN PATENT DOCUMENTS

| | | | |
|---|---|---|---|
| 16979 | 1/1987 | Japan | 271/217 |
| 734103 | 5/1980 | U.S.S.R. | 414/793.5 |

*Primary Examiner*—Thomas J. Brahan
*Attorney, Agent, or Firm*—Stanton D. Weinstein

[57] ABSTRACT

Flat mail pieces of intermixed sizes and thicknesses are received and distributed to separately arranged storage compartments. Each such compartment contains special features and functions which ensure smooth entry of incoming mail, maintain the facing and orientation of received mail pieces, readily permit stack accumulation, and readily enable release of a full stack from the storage compartment. A vertically-mobile stack support plate maintains a relatively short but constant drop distance for all mail pieces entering the stacking compartment. To transfer a stack of mail, the stack is stripped off its support plate and onto a bed of rollers by lateral movement of the storage compartment away from the support plate. After a tray container has been positioned to accept the stack of mail, the bed is rolled out from beneath the stack, gently transferring the stack onto the bottom of the tray.

38 Claims, 8 Drawing Sheets

APPARATUS AND METHOD FOR ACCUMULATING AND TRANSFERRING ONE OR MORE STACKS OF ARTICLES

FIELD OF THE INVENTION

The present invention relates to material or article handling, and more particularly to stack forming apparatus and method with means for moving a filled or otherwise completed stack from its stacking location. The present invention also relates to sorting devices such as for mail flats and similar articles.

BACKGROUND OF THE INVENTION

In mail processing as well as in processing for a delivery service, it is usually necessary at some point to sort the mail such as according to geographical destination. Where large volumes of mail are involved, many large stacks of sorted mail may result from such sortation. Thus, there is a need to transfer sorted stacks of mail from a sorter to a user such as an induction station, preferably while the sortation process is still underway. The present invention fulfills this need.

In general, flat mail (also referred to as flats) includes mail pieces from 3½ inches by 5 inches to 15 inches by 15 inches, with thickness up to one inch and weight up to three pounds. When it is necessary to collect and form a deep stack height of intermixed flat mail, two common problems occur. With little or no mail in the intended storage compartment, mail making its entry tends to nose-dive or tumble to the top of the stack, making it at least difficult to maintain stack integrity. Also, at some point, the stack must be evacuated from its temporary or operating storage location so that it can be transferred to a user. The present invention solves both of these problems. The difficulties provided by these problems are worsened when the items to be stacked are of varying sizes, such as mail flats. Where all items to be sorted are of a known or uniform size, such as A4 paper or 8½ inch by 11 inch paper, these items will stack more easily than if they are of varying sizes. With flats, the size, stiffness, thickness and weight of the mail pieces can vary substantially. In contrast, letter mail size and related characteristics vary to a much lesser degree than flats. The smaller the differential in size, the more manageable stack accumulations and transfers become. Also, because of these variations, presence of a common registration edge for stacking is not available with mail flats.

In mail processing as well as in processing for a delivery service, it is usually necessary at some point to sort or separate mail pieces by intended destination region or location. Sorting mail pieces is an essential step in processing the mail pieces to their ultimate destination. Sorting usually is accomplished in a series of steps or stages. First, all mail pieces received are sorted based on which relatively large geographic region they are addressed to. All mail pieces for each such region are then sorted by sub-regions and so on. Once mail pieces have been fully sorted, large numbers of mail pieces can be directed and transported together, usually to an intermediate point, before being delivered to their final destination, based on the result of the sorting process.

In the prior art, mail would be provided on a single conveyor belt to an automatic, or an attended, mail sorter. With an attended sorter, mail appears on this conveyor on demand; the conveyor is triggered by the attendant to deliver mail pieces. The attendant reads the address on each mail piece, and inputs to the sorter address information for each mail piece, just before that mail piece is provided to, or inducted into, the sorter. Alternatively, the mail piece could be provided with an automatically machine-readable label or device such as a bar code sticker, but the attendant would have to orient the mail piece so that such label or device would be exposed in a position where it could be detected and read by the sorter. In any of the above situations, because of the rather large daily volume of mail pieces handled and the large number of possible destinations, it is usually necessary to sort mail pieces in stages by geographic regions of successively smaller size. It is therefore necessary to collect and transfer like-sorted mail for one such region from an output of one such sorter to an input of another such sorter for the next stage in sortation processing. It is much easier to collect, transfer and reinduct an organized stack of such mail between sorting steps instead of a disorganized collection of such mail pieces. If the mail is not stacked, the mail is more difficult to handle, and jams can result.

A common stacking problem for mail flats results from the height disparity between a near-empty and a near-full container bin. When a bin is at its near-empty level, the trajectory of mail pieces entering the bin becomes unpredictable because of the wide variations in mail characteristics such as thickness, size, stiffness, friction, etc. coupled with the gravitational free-fall conditions they produce. Maintaining good stack quality under such circumstances is difficult. For this reason, simply employing a plastic tray as the receiving bin for the direct accumulation of mail cannot offer reliable stack quality.

Difficulty has also been encountered in maintaining stack integrity, especially while moving or transferring a stack. An open tray and a three-sided tray have been unsuccessfully tried for confining a moving stack.

Thus, there is a need to create and transfer a plurality of manageable stacks of sorted mail or other articles, such as for mail processing or other delivery processing. The present invention fulfills this need.

SUMMARY OF THE INVENTION

Accordingly, an object of the present invention is to provide apparatus and method capable of transferring a stack of flats or the like from one location or container to another.

Another object of the present invention is to provide apparatus and method capable of properly forming and maintaining a stack of flats.

A further object of the present invention is to provide apparatus and method capable of supporting a stack of flats or the like while maintaining a constant near-full stacking condition.

Still another object of the present invention is to provide apparatus and method capable of permitting the bottom stack support or floor to be withdrawn from a stack when the stack has reached a desirable height limit or size.

A still further object of the present invention is to provide apparatus and method capable of gently and effectively transferring support of a stack of flats or the like.

Yet another object of the present invention is to provide apparatus and method capable of receiving and accumulating flat mail pieces of intermixed sizes and thicknesses as they are singularly provided to a particular location.

Still another object of the present invention is to provide apparatus and method capable of ensuring the smooth entry of incoming mail to such a stack, maintaining the facing and orientation of such flats, and providing for reliable stack accumulation.

A still further object of the present invention is to provide apparatus and method capable of fixing the incoming insertion trajectory with the top of a stack of flats or the like regardless of stack size, maintaining good stacking quality, maintaining the faced and oriented status of such mail flats, and effecting smooth and reliable transfer of full mail stacks from a temporary storage or receiving location into another container such as a mail tray for transfer to another location for further processing.

Briefly, these and other objects of the present invention are accomplished by a stack accumulator and transfer mechanism which is intended to provide more reliable stacking. This mechanism includes a compartment which is open at the top and bottom except that it is provided at its bottom with a removable roller bed. Each such mechanism furthermore has a vertically movable stack support plate which is initially disposed near the top of the compartment. Items are placed on the support plate by a suitable delivery system. The support plate is controlled by a motor which in turn is controlled by a top surface stack sensor. As more items are placed on the support plate, the support plate is moved downward by the motor. When the compartment is full, the compartment is moved away from the support plate, so that the stack of mail now instead rests on the roller bed. The stack can now be placed above a suitable receptacle, whereupon the roller bed is withdrawn so that the stack enters this receptacle. The receptacle is then lowered to remove the items from the compartment. The roller bed can then be replaced, the compartment can be returned to the support plate, and the support plate can be moved upward by the motor. The compartment can now begin to accept items for stacking once again. Where multiple such compartments are used, and mail flats are being sorted such as by destination, sorting of mail into trays can thereby be accomplished.

Other objects, advantages and novel features of the invention will become apparent from the following detailed description of the invention when considered in conjunction with the accompanying drawings.

DESCRIPTION OF THE PREFERRED EMBODIMENT

Figure 1:
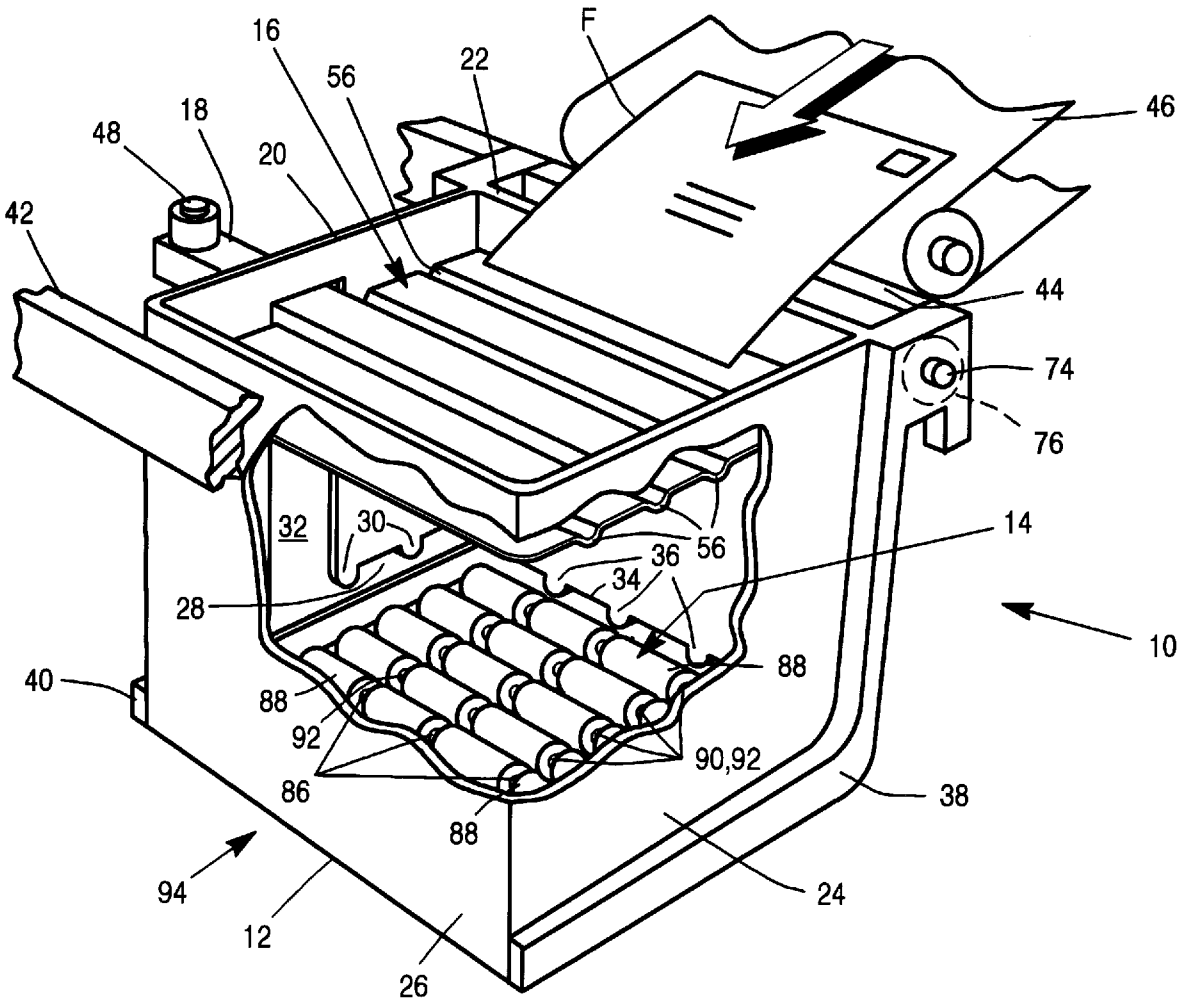
FIG. 1 shows, in a pictorial view, one embodiment of a stack accumulator/transfer module according to the present invention, with a portion of a feeding apparatus served thereby.
Figure 2:
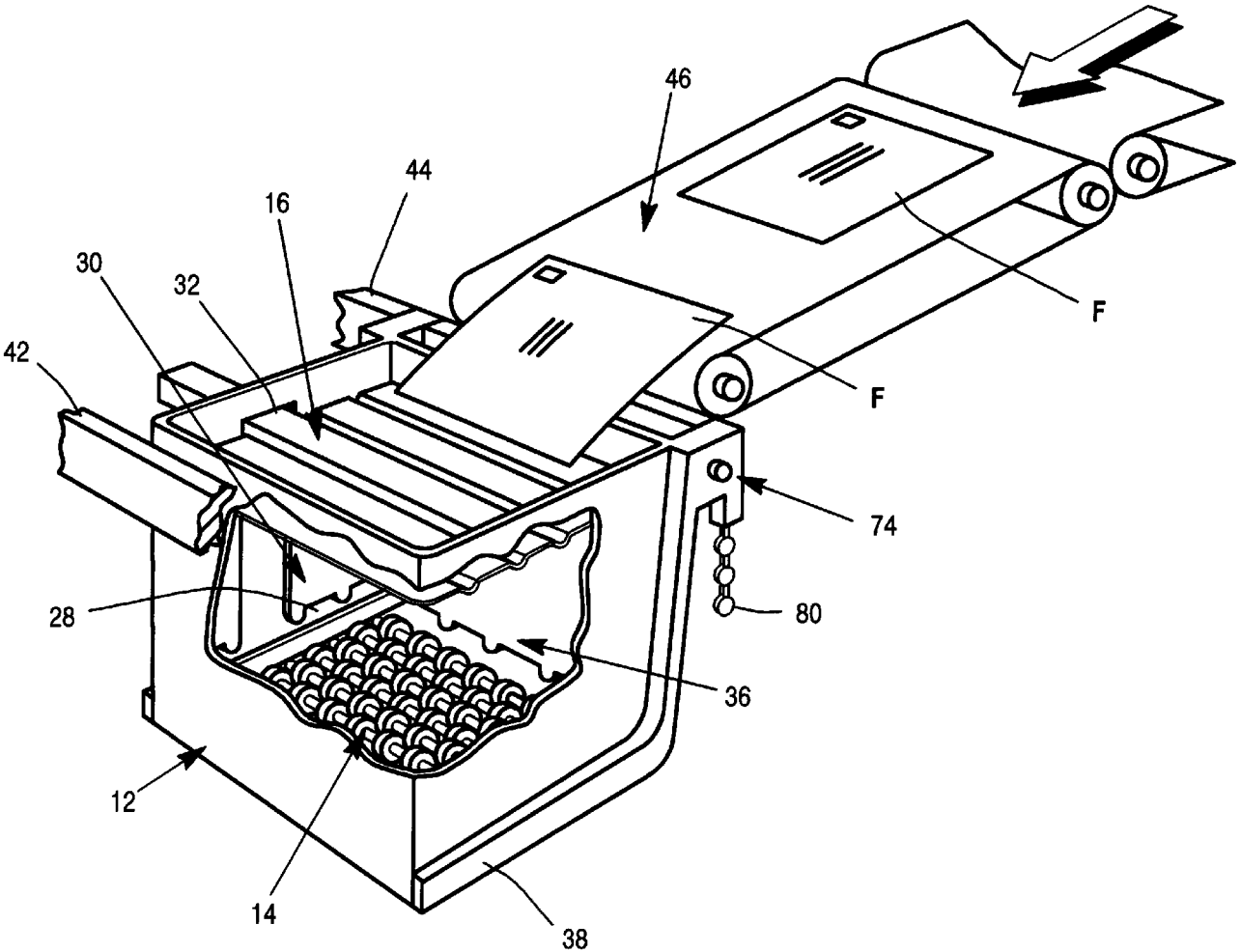
FIG. 2 is another pictorial view of the module of FIG. 1.
Figure 8:
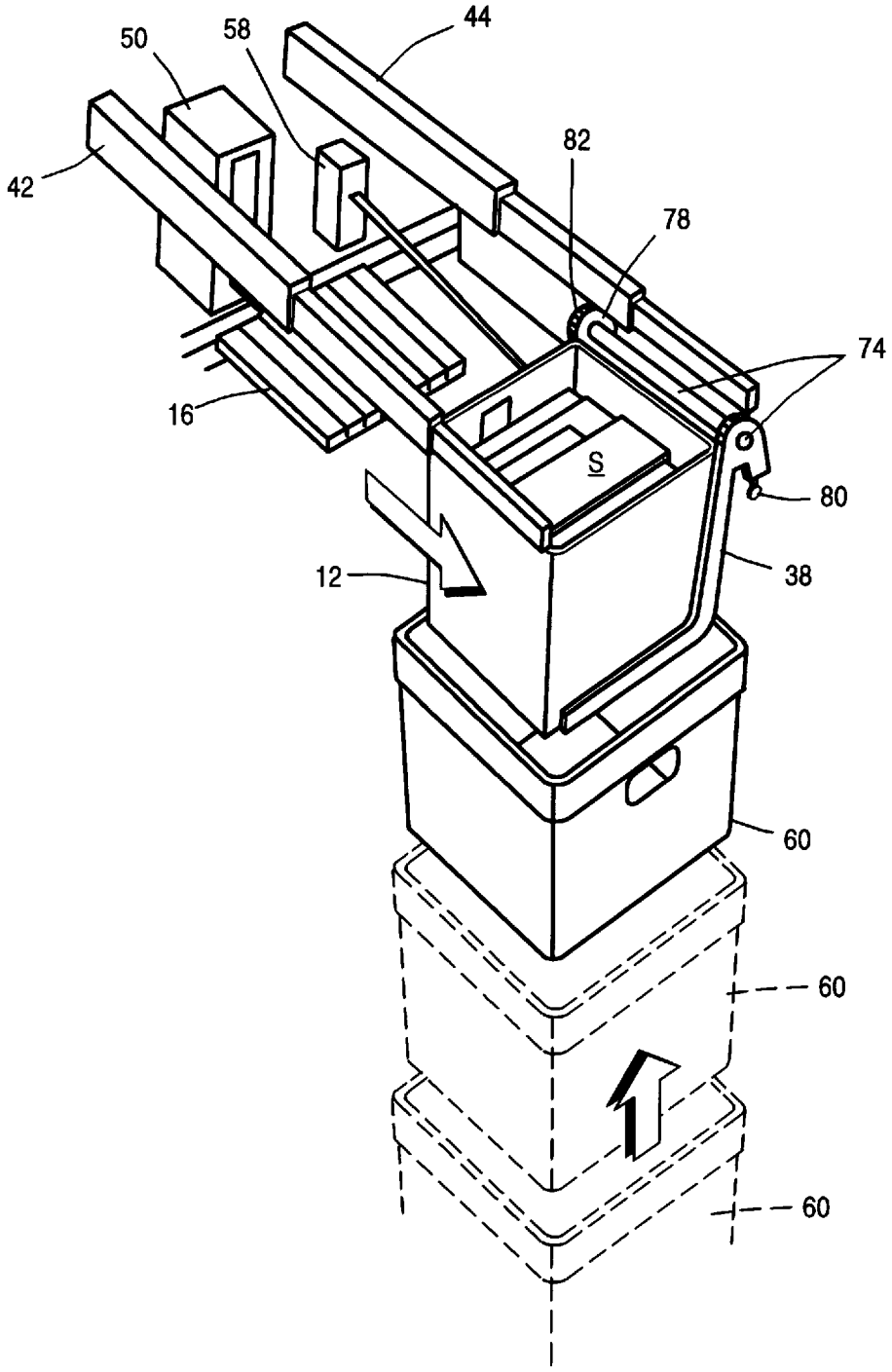
FIG. 8 shows, in a pictorial view, the module of FIG. 5 shown in still another operating position subsequent to that of FIG. 7, with a tray or container being provided to that module for subsequent reception of items therefrom.
Figure 14:
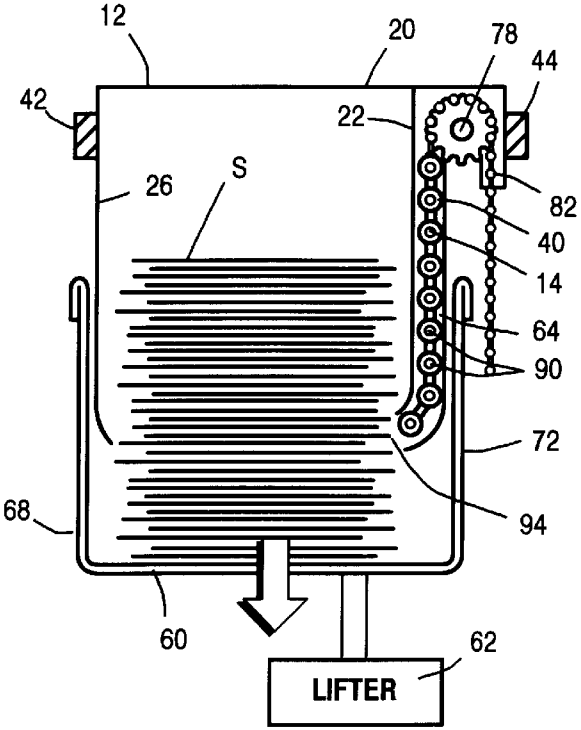
FIG. 14 is a cross-sectional view of the module and tray of FIGS. 9 and 12 shown in a stage of operation subsequent to that of FIG. 13.
Figure 12:
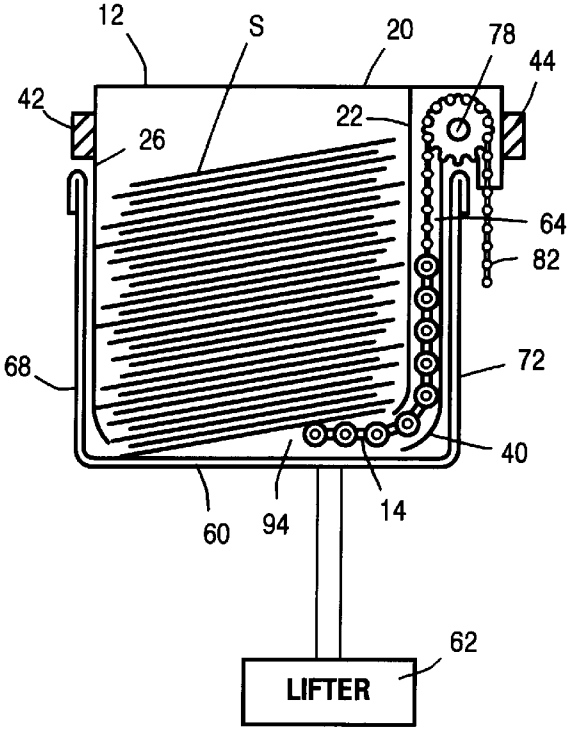
FIG. 12 is a cross-sectional view of the module and tray of FIG. 9 shown in a stage of operation subsequent to that of FIG. 11.
Figure 9:
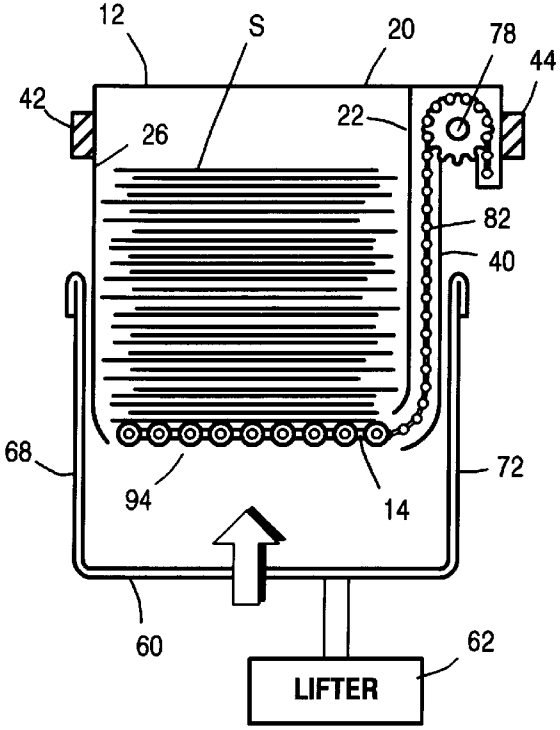
FIG. 9 is a cross-sectional view of the module of FIGS. 3, 4, 6 and 7 after removal from the stack support plate and associated motorized hardware of those figures, and of a tray such as that of FIG. 8.
Figure 10:
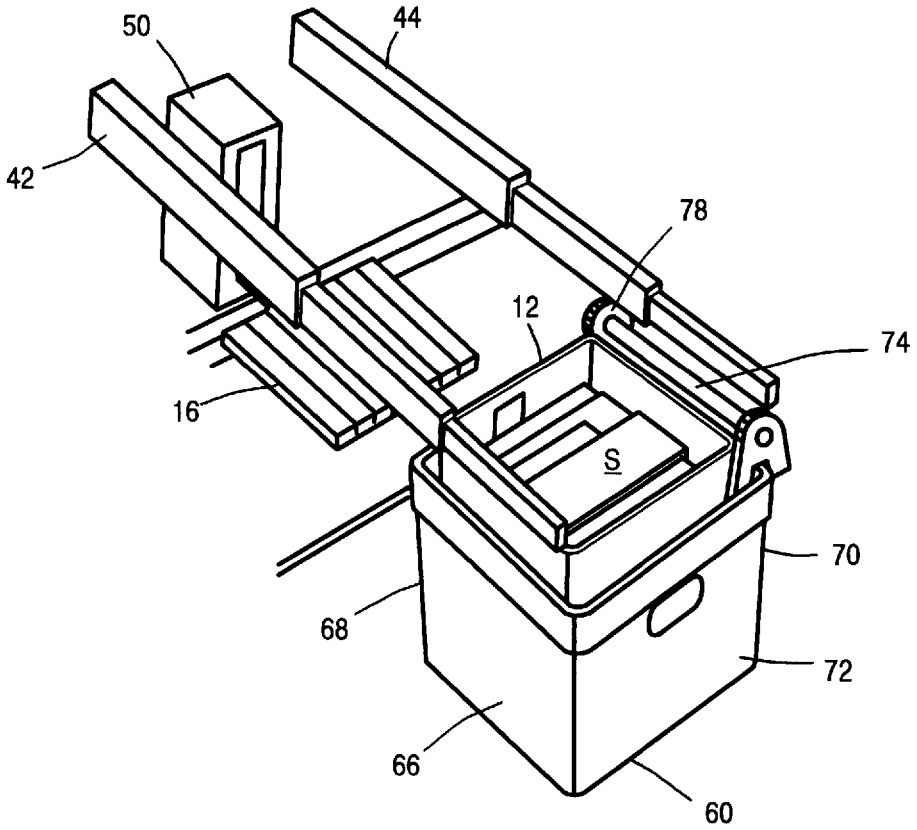
FIG. 10 shows in a pictorial view the system and module of FIGS. 5 and 8, and a tray of FIG. 8, shown in a stage of operation subsequent to that of FIG. 9.
Figure 11:
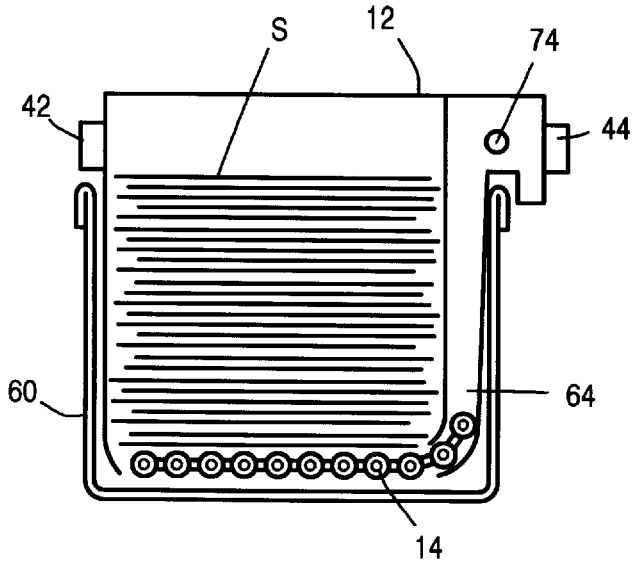
FIG. 11 is a cross-sectional view of a portion of the module of FIG. 10 shown in a stage of operation subsequent to that of FIG. 10.
Figure 13:
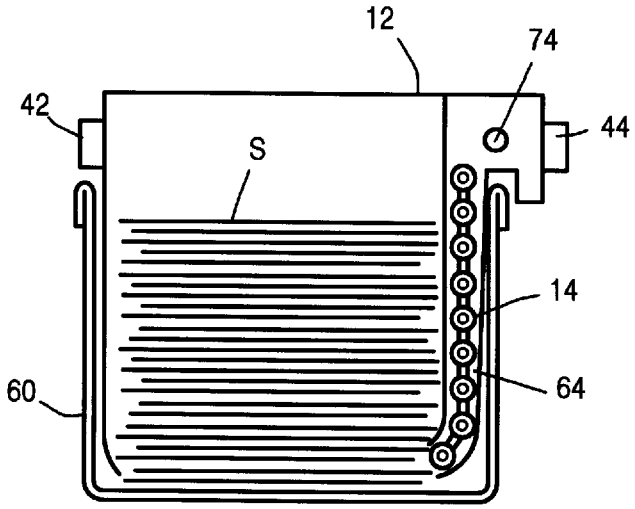
FIG. 13 is a cross-sectional view of the module of FIG. 11 shown in a stage of operation subsequent to that of FIG. 12.

Referring now to the drawings, wherein like reference characters designate like or corresponding parts throughout the several views, there is shown in FIG. 1 a stack accumulator and transfer module 10 including a compartment or bin 12, a movable roller bed 14, and a vertically mobile stack support plate 16. Support plate 16 as illustrated is preferably in the shape of a paddle having a handle or tongue 18 by which the support can be vertically displaced. Compartment 12 has four sides or walls 20, 22, 24 and 26, and is open at its top and bottom. Wall 20 is provided with a lower opening 28, into which fingers 30 project, configured to permit plate 16 to pass therethrough unrestricted. Wall 20 is also provided with an opening 32 perpendicular to and connected to opening 28, to accommodate vertical movement of tongue 18. Extending below wall 22 from its bottom or lower edge 34 are projecting fingers 36, configured to permit roller bed 14 to pass therethrough unrestricted while helping to retain any article(s) resting on that bed. Bed 14 slidably engages and is supported by channel guides or chain guide tracks 38 and 40 disposed on certain edges of compartment 12. Channel guide 38 is disposed on the bottom or lower edge of bin 12 sidewall 24 along the extended position of bed 14 (shown in FIGS. 1, 2, 5 and 9), and on the vertical edge of sidewall 24 just beyond adjacent sidewall 22. Channel guide 40 is disposed on the bottom or lower edge of bin 12 sidewall 20 along the extended position of bed 14 (shown in FIGS. 1, 2, 5 and 9), and on the vertical edge of sidewall 20 just beyond adjacent sidewall 22. Channel guides 38 and 40 thus guide and support bed 14 in its extended position of FIGS. 1, 2, 5 and 9, in the bed's withdrawn position of FIGS. 13 and 14, and between the bed's extended and withdrawn positions such as is shown in FIG. 12. Bed 14 in its withdrawn position is disposed outside of wall 22, as shown in FIGS. 13 and 14. As is also shown in FIGS. 2, 8 and 10, module 10 is supported by bin supporting slides 42 and 44. FIGS. 3–6 each show stack support plate 16 retaining stack S. FIGS. 9 and 11 each show roller bed 14 retaining stack S.

Figure 3:
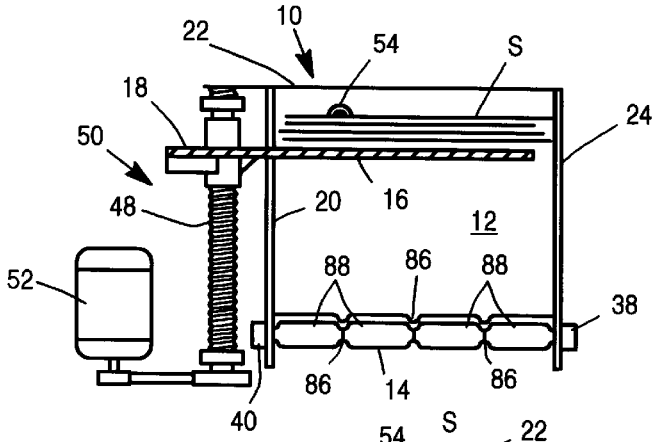
FIG. 3 is a cross-sectional view of the stack accumulator/transfer module of FIGS. 1 and 2 according to the present invention shown in one operating position.
Figure 4:
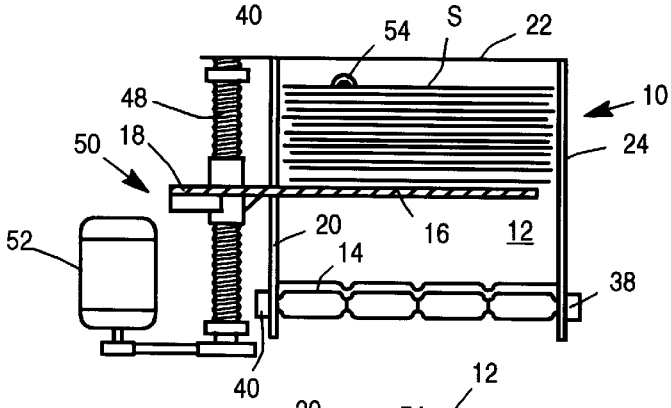
FIG. 4 is a cross-sectional view of the module of FIG. 3 shown in another operating position subsequent to that of FIG. 3.
Figure 6:
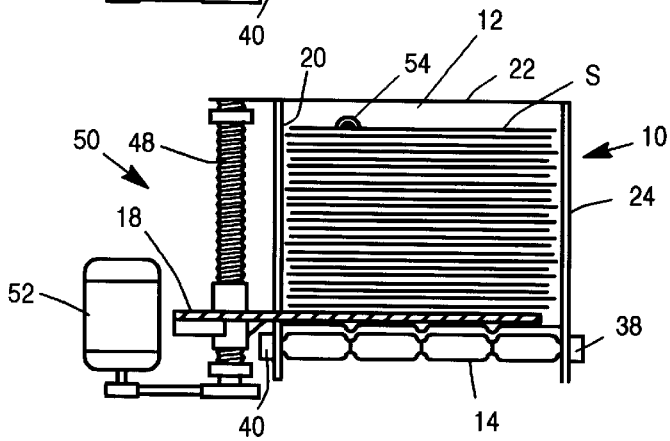
FIG. 6 is a cross-sectional view of the module of FIGS. 3 and 4 shown in a stage of operation subsequent to that of FIG. 5.
Figure 7:
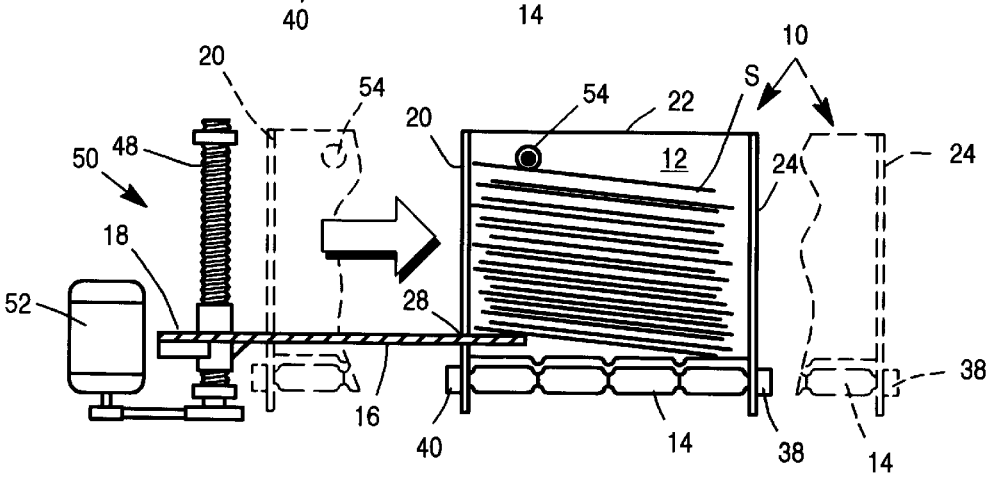
FIG. 7 is a cross-sectional view of the module of FIGS. 3, 4 and 6 shown in a stage of operation subsequent to that of FIG. 6.
Figure 5:
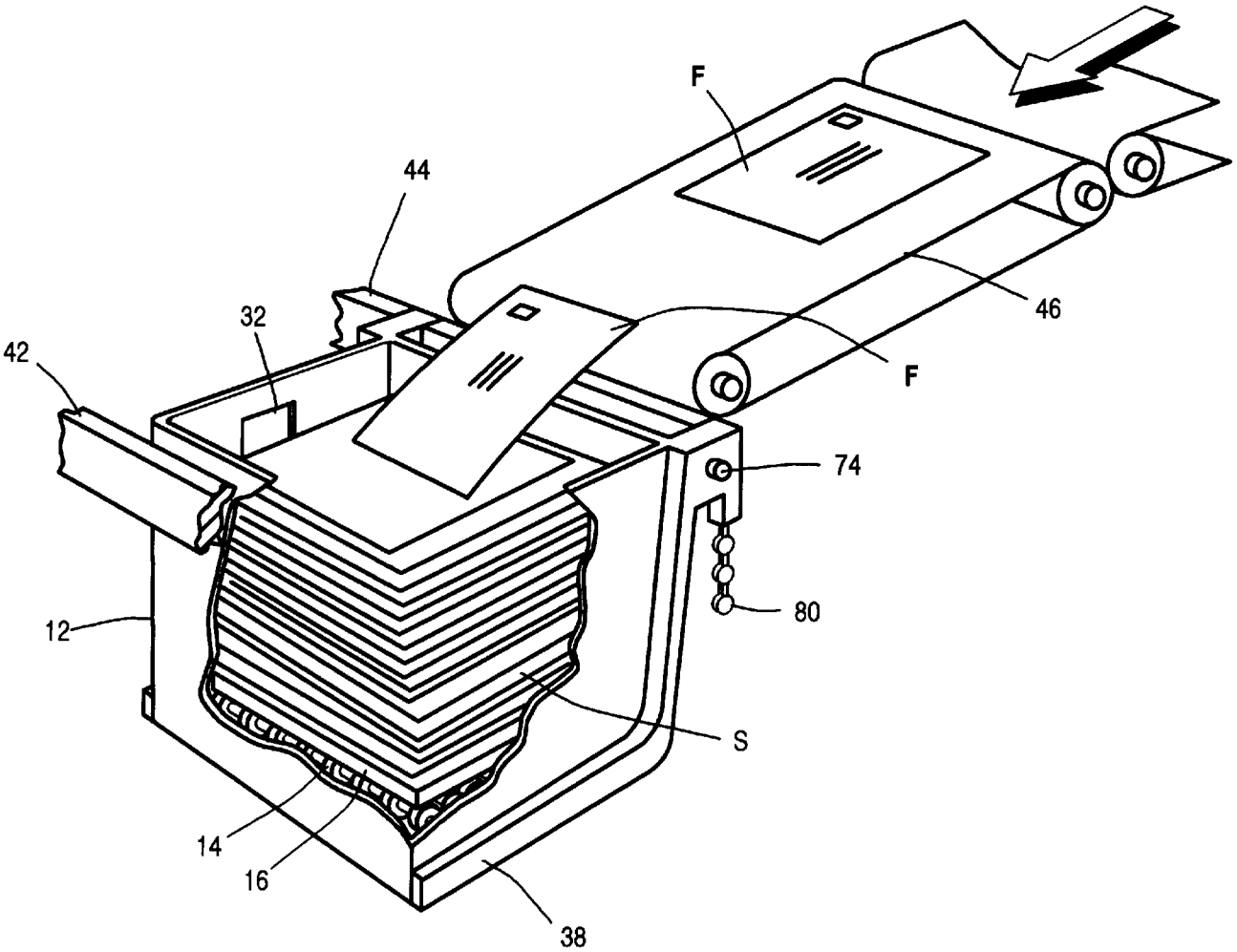
FIG. 5 shows, in a pictorial view, a module such as that of FIG. 3, shown in a stage of operation subsequent to that of FIG. 4.

As shown in FIG. 1, a mail flat F can be provided to module 10 via a delivery conveyor belt 46 or other suitable means. A mail flat F provided by belt 46 to module 10 would be placed by the belt on support plate 16 or on any mail flats that had preceded that flat F to plate 16. Stack support plate or paddle 16 is raised and lowered within compartment or bin 12 by motorized shaft 48 of drive mechanism 50. Shaft 48 is driven by motor 52 of drive mechanism 50. FIGS. 3–7 show different stages of stack accumulation. FIG. 3 shows module 10 with a near-empty bin 12. FIG. 4 shows module 10 with a partially full bin 12. FIG. 5 shows module 10 with a near-full stack condition, with stack support plate 16 in close proximity with roller bed 14. FIG. 6 shows module 10 with a full bin 12. As shown in FIGS. 3–6, as stack S becomes taller, sensor 54 causes motor 52 via shaft 48 to lower support plate 16 to maintain a preferred upper position for the top of stack S. This lowering of plate 16 continues until plate 16 is disposed just above or rests on bed 14, such as is shown in FIG. 6. Lateral movement of bin 12 then strips stack S off support plate 16 and onto bed 14, as shown in FIG. 7. FIGS. 7 and 8 show the start of the bin 12 evacuation process.

As is further described below, regarding FIGS. 3–8, initially stack support plate 16 is disposed near the top of compartment 12 to the extent permitted by rectangular opening 32 of inboard compartment wall 20. Plate 16 is provided with a rigid projection or tongue 18 configured to be vertically movable within opening 32. Plate 16 is connected by tongue 18 to shaft 48 of drive mechanism 50. As more mail flats are provided to plate 16, top surface stack sensor 54 is covered or blocked. In response to this blockage, drive motor 52 of drive mechanism 50 causes shaft 48 to rotate, thereby lowering plate 16 until the blockage of sensor 54 is removed. In this manner, as more articles 10 are provided to plate 16 over time, drive mechanism 50 causes plate 16 to be lowered to a level controlled by sensor 54. In this manner, the drop distance of an article from belt 46 to plate 16 is controlled, and is preferably kept relatively small, to ensure good stacking and good stack integrity even where articles of different sizes are being provided to the same compartment 12 and thus to the same stack S. When stack support plate 16 is thereby lowered to a predetermined lower level, compartment 12 is laterally moved therefrom as shown in FIGS. 7 and 8. As shown in FIG. 8, bin 12 support slides 42 and 44 are extended and bin 12 is moved laterally away from plate 16. This lateral movement can be accomplished by an air cylinder or other driver 58 fixed to the same frame as drive mechanism 32, and fixed to a part of wall 20 above the uppermost level of plate 16. Alternatively, this lateral movement could be accomplished by introducing compressed air or other gas to the interior of telescoping slides 42 and 44, or by motorizing slides 42 and 44 to extend and withdraw.

Removal of compartment 12 from plate 16 causes removal of the bottom of the stack S disposed in that compartment from plate 16 also. As shown in FIGS. 8, 9 and 11, this causes the bottom of stack S in compartment 12 to be moved off of plate 16 onto roller bed 14. This removal is facilitated utilizing grooves 56 formed in at least the upper surface of plate 16, horizontally oriented opening 28 in wall 20 communicating with opening 32, and fingers 30 of wall 20 extending into opening 28. Fingers 30 are configured to enter and cooperate with grooves 56. This removal is accomplished in the following manner. Although it is preferred that the distance stack S must fall when moving from plate 16 to bed 14 be as small as possible, nonetheless plate 16 and bed 14 must be at least slightly separated during this process so that plate 16 does not contact bed 14 while compartment 12 is being removed from plate 16. However, unless opening 28 is made very narrow with very tight tolerances, it would be at least difficult to prevent article(s) in the bottom of stack S from remaining on plate 16 while compartment 12 is being removed therefrom. Obviously, such tolerances would be undesirable for practical operation as well as difficult to effectuate. Accordingly, grooves 56 leave a space below the bottom surface of stack S which fingers 30 can enter. As described above, when compartment 12 has become sufficiently filled, sensor 54 will have caused lowering of plate 16 within compartment 12 to be at a predetermined desired lower level. Compartment 12 is then laterally moved on slides 42 and 44 away from plate 16 and belt 18. This lateral movement can for example be accomplished by an air cylinder, a piston or a sprocket mechanism. During such lateral movement, fingers 30 and wall 20 push stack S off plate 16 and thus onto bed 14. Since fingers 30 can enter grooves 56, but are configured to not engage those grooves, fingers 30 can thereby extend below the bottom level of stack S to ensure that the bottom article(s) of stack S do not remain on, or would be pushed off, plate 16.

FIGS. 7–14 sequentially illustrate steps or stages in the evacuation of stack S from module 10 and transfer of stack S from module 10 to tray 60. In FIGS. 7 and 8, slides 42 and 44 are extended, and compartment 12 is moved laterally, so that stack S is stripped off plate 16 and on to bed 14. As shown in FIGS. 8, 9 and 10, an empty tray 60 is raised from below extended compartment 12 to engulf compartment 12. In FIGS. 10 and 11, tray 60 has been elevated by a suitable lifter 62 to engulf stacker bin 12 and to be positioned to receive stack S when the stack is released from bin 12. FIGS. 11–14 illustrate how release of stack S from compartment 12 is accomplished. In FIGS. 9 and 11, before stack release, stack S rests on bed 14. In FIG. 12, roller bed 14 is withdrawn to release stack S into tray 60. In FIG. 13, such withdrawal of bed 14 into the space 64 between bin 12 and tray 60 wall 66 releases stack S from compartment 12 to tray 60. In FIG. 14, the newly filled tray 60 is lowered by lifter 62 to evacuate stack S from bin 12.

After stack S and compartment 12 have been removed, or while stack S and compartment 12 are being removed, from plate 16, a tray 60 or other container or receptacle is moved up to engulf compartment 12, as shown in FIGS. 8 and 9. Tray 60 is provided with four sidewalls 66, 68, 70 and 72. Tray 60 can be raised in place by a suitable lifting platform, elevator or other means 62. Lifter 62 can for example be similar to the lifting apparatus described above for support plate 16. Although the configuration of FIGS. 9–14 will operate if compartment 12 merely enters tray 60, it is strongly preferred that most of compartment 12, and all or nearly all of stack S, thereby become disposed within tray 60, to minimize any disturbance of the stack when it is transferred from compartment 12 to tray 60, as shown in the pictorial view of FIG. 10 and the cross-sectional view of FIG. 11. Thereafter, drive shaft 74 rotates, causing gear or sprocket 76, and a second such gear or sprocket 78, connected thereto to likewise rotate. Such rotation of gear or sprocket 76 by drive shaft 74 causes chain 80 engaging gear 76 to be pulled up and over gear 76. Likewise, such rotation of the other gear or sprocket 78 by drive shaft 74 causes the chain 82 engaging that gear to be pulled up and over that gear. Chain 80 is connected at one end to one end of roller bed 14. Also, the chain 82 is connected at one end to one end of roller bed 14. Drive shaft 74 is driven by an appropriate drive or motor 84. Driver 84 is preferably a motor connected to and moving with gear 78 or an extension of shaft 74 beyond gear 78. Driver 84 can be powered by a flexible service cable or a flexible service loop cable. Driver 84 can be direct-coupled to either gear 76 or 78 or to shaft 74 (such as at one end of shaft 74) to provide power to extend and withdraw the roller bed 14. Thus, drive shaft 74 is now rotated by drive 84 to pull roller bed 14 out from beneath compartment 12 and stack S and to enter the space 64 between compartment wall 22 and the nearest wall 66 of tray 60, as shown in FIG. 12. Such removal of bed 14 causes stack S to now instead rest on the bottom of tray 60, as shown in FIG. 13. The filled tray 60 can now be lowered by lifter 62 to evacuate the mail stack S from bin 12, as shown in FIG. 14. The four walls 20, 22, 24 and 26 of bin 12 maintain stack S integrity even during lateral movement of bin 12. The four walls 66, 68, 70 and 72 of tray 60 maintain stack S integrity even during movement or transfer of stack S therein to another location or user. However, it is more difficult to evacuate the contents of the four-sided stacker bin into the four-sided tray, a difficulty which is overcome by the present invention.

Fingers 36 at the bottom 34 of bin wall 22 are configured to easily enter corresponding gaps 86 between rollers 88 of bed 14. Bed 14 includes a plurality of rollers 88 arranged in rows, as shown in FIG. 1. Each such row can have a common central rod or pivot 90 about which the rollers 88 slidably or rotatably disposed thereon can freely rotate (e.g. with the aid of roller bearings or journal bearings) with the individual rollers 88 thereon being separated thereon such as by washers of spacers 92 to form gaps 86. Rods 90 can extend into guides 38 and 40 to provide support and guidance for bed 14. As shown in FIG. 1, gaps 86 are arranged in columns or in a series of lines through each of which a finger 36 passes. An alternative arrangement of rollers 88 is shown in FIG. 2, but a plurality of colinearly arranged gaps 86 is still present.

Thus, fingers 36 in cooperation with gaps 86 prevent any bottom article(s) of stack S from remaining on bed 14 when bed 14 is withdrawn from the bottom of compartment 12. Once tray 60 has been completely removed from bin 12, drive shaft 74 can be rotated by its driver 84 in the opposite direction to return roller bed 14 to the bottom of bin 12, bin 12 can be returned to support plate 16, and plate 16 can be raised to its upper position shown in FIG. 1. Compartment 12 can now receive another load of articles.

Movement of compartment 12 on slides 42 and 44 can be controlled by a suitable motor or driver 58 such as a motorized piston connected to wall 20.

Module 10 can be one of several such modules each connected to the output of a device such as a postal sorter for flats. Mail flats are provided to paddle 16 on a selected basis. A plurality of such modules can be arranged in a stack, in a line, in a column or in a matrix. It would be possible to construct a densely populated matrix of these modules. Mail flats can be provided to a module 10 by a delivery conveyor belt 46 or by other suitable means. While compartment 12 is withdrawn from such an arrangement, an alternate bin or a backup bin could be used instead, or alternatively operation of the entire system or of a portion thereof could be stopped until the filled compartment 12 is unloaded and returned to its place in that system.

As shown in FIG. 2, a bin 12 is provided to accept and accumulate mail at the sort point. The bin 12 is supported by a pair of slides 42 and 44 which can extend in a manner similar to a file cabinet drawer when the bin is ready to be evacuated of its mail. Within the bin 12, a stack support plate 16, preferably shaped like a paddle, is provided which serves to maintain a reasonably constant relation between the top of an accumulating mail stack S and the point of entry of incoming mail. The stack paddle or plate 16 extends out through the rear wall 20 of the bin 12 where it is connected to a drive system 50. The drive system 50 controls the vertical position of the support plate 16, lowering the plate as necessary under the direction of a sensor 54 which monitors the top surface of the stack S. Blockage of the sensor 54 will cause the stack to be lowered to compensate for the detected accumulation.

The base 94 of bin 12 serves two purposes. The base 94 permits the transfer of the mail stack from support plate or paddle 16 onto roller bed 14, allowing the plate or paddle to be withdrawn from the bin. Base 94 also provides a smooth and effective release of the mail stack S from confinement by the bin 12 after a tray 60 has been delivered and positioned to accept the stack S.

In operation, mail entering the bin 12 is allowed to accumulate as the plate or paddle 16 maintains the position of the top of the mail stack S, as shown in FIGS. 3, 4, 5 and 6. When the stack support 16 has been lowered a preset distance to be in close proximity to roller bed 14, drive mechanism 50 generates a signal that the bin 12 is full or near full and must be evacuated. Bin 12 is then extended on its supporting slides 42 and 44, as shown in FIG. 7 and in FIG. 8, to move its mail stack S out of the module's 10 transport path. A bypass command is also initiated for the sort point, so that additional mail is not provided to that sort point until the bin has been emptied and replaced. As the bin 12 is extended, the plate 16 supporting the stack S remains stationary. This causes the stack S to be pushed by the rear wall 20 of the bin 12, sliding the stack S off the plate 16 and onto the roller bed 14 of the bin. To ensure smooth and reliable transfer of the stack S, the plate 16 preferably is provided on its upper surface with devices such as rollers or balls which minimize frictional resistance of the stack S to sliding off the plate.

In the process of extending the bin 12 out of its receiving position of FIGS. 1, 2 and 5, an empty tray 60 is dispatched and elevated by lifter 62 from its nearby ready position to accept the mail stack S in that bin. The arrival of empty tray 60 at bin 12 is preferably timed to coincide with the bin's arrival, although of course the tray could be provided to the bin after the bin has been fully laterally extended. The tray 60 is positioned to engulf the bin 12 and its mail stack S and comes to rest so that its bottom surface is in close proximity with the bottom 94 of the bin and its roller bed 14, ready to accept the released stack, as shown in FIG. 10.

The bottom 94 of bin 12 provides for reliable release of the stack S within the confines of a mail tray container 60. The bottom 94 of bin 12 includes a network 14 of low friction rollers 88 which are supported and connected with guide tracks 38 and 40 at the front 24 and rear 20 sides of the bin 12. When all of the functioning elements of the stacker system 10 are ready for a stack S release, the bed 14 of the bin 12 is rolled open via a pair of guided chain segments 80 and 82 (one such segment 82 shown in FIGS. 9, 12 and 14) straddling the bed. The two chain segments 80 and 82 are power-driven by driver 84 via drive shaft 74 and gears 76 and 78 to withdraw bed 14 and effect the opening of the base 94 of bin 12. The roller bed 14 supporting the stack S is withdrawn behind one side wall 22 of the bin 12, allowing the stack S to be gently deposited on the tray 60 bottom. The rollers 88 of the bed 14 aid in this process by eliminating, for all practical purposes, any sliding friction between the bottom of the stack S and the bed 14, to ensure reliable separation of stack and bed. Also, the bottom edge 34 of the side wall 22 of the bin 12 is provided with fingers 36 to intermesh with the roller bed 14 as the bed is withdrawn, to further ensure that all mail is cleanly retained in the compartment 12 and tray 60.

With the stack S resting on the tray 60 bottom and the stack confined by the four walls 20, 22, 24 and 26 of the 35 bin 12, the tray 60 and the stack S it now supports are now lowered to the tray's parked position where the full tray is exchanged with an empty tray and conveyed to other facility areas for subsequent handling. Concurrently, the bin 12 is retracted back into its mail collecting position after or preferably while its roller bed 14 is restored to its closed state.

Some of the many advantages of the invention should now be readily apparent. For example, a stacking apparatus and technique have been provided which are capable of providing reliable stacking and handling of full spectrum flat mail, including the unassisted operation of tray loading and sweeping functions. Recognizing that floor space for mechanized operations is severely limited in many postal facilities, the stacking and sweeping functions being thereby provided are efficiently packaged to maximize space utilization. Such apparatus and method addresses and overcomes many problems usually encountered in the stacking and sweeping of flats. For example, in the prior art, a common stacking problem results from the height disparity between a near-empty and a near-full container. When a container is at its near-empty level, the trajectory of a mail piece entering the container becomes unpredictable because of the wide variations in mail characteristics such as thickness, size, stiffness, friction, etc. coupled with the gravitational free-fall conditions they produce. Maintaining good stack quality under such circumstances is difficult. In the present invention, a bin is provided having the ability to maintain a constant, near-full stacking condition even when the bin is empty. To provide this feature, a bin has been provided which includes specific elements which support the stack while maintaining a constant near-full stacking condition, permit the stack support to be withdrawn from the bin when the bin has become full, provide for the automatic delivery and positioning of an empty tray to accept the mail stack, and gently and effectively transfer support of the stack onto the bottom of the mail tray.

The present invention provides a means of receiving and accumulating flat mail pieces of intermixed sizes and thicknesses as they are singularly distributed to a multiplicity of separately arranged storage compartments. Each such compartment contains special features and functions which ensure smooth entry of incoming mail, maintains the facing and orientation of incoming mail, and provides for reliable stack accumulation. The present invention also provides for smooth release and transfer of a full stack from its storage compartment into a mail container. A vertically-mobile stack support plate is provided to maintain a relatively short but constant drop distance for all mail pieces entering the stacking compartment. An ability is also provided to reliably strip a stack of mail off its support plate and onto a bed of rollers which form the base of the stacker compartment. After a tray container has been positioned to accept a stack of mail, this bed can be rolled out from beneath the stack, gently transferring the stack onto the bottom of the tray.

Thus, there has been provided apparatus and method for reliable accumulation of articles into one or more stacks, and for transfer of such stack(s). This apparatus and method can be used with mail flats, whose size, stiffness, thickness and weight can vary substantially, e.g. more so than with letter mail. The smaller the differential in such characteristics, the more manageable stack transfers become. Stack transfers of flats mail is more difficult, and therefore requires a greater deal of containment, than do uniform articles or even letter mail, making a four-sidewalled container for such mail very desirable. A stack having height ranges of 8 inches or more and with substantial variations in the size of its individual pieces, cannot be conveyed reliably without a means of containment on all four sides of the stack. Otherwise, the stack would fall apart when moved. The present invention is furthermore capable of loading a stack into a four-sidewalled container, which is more difficult than, for example, simply moving or pushing a stack laterally on or onto an unwalled moving base. The present invention tolerates and accepts mail pieces having no common registration edge during its transit, yet is still able to produce a quality stack.

The present invention addresses problematic areas of flats stacking and handling in mail processing systems. The incoming insertion trajectory is fixed with the top of the stack regardless of stack size. Good stacking quality is maintained. The faced and oriented status of the mail is also maintained. Smooth and reliable transfer of full mail stacks from the compartment into mail trays is also effected.

Obviously, many modifications and variations of the present invention are possible in light of the above teachings. It is therefore to be understood that the foregoing embodiments are presented by way of example only and that, within the scope of the appended claims and equivalents thereto, the invention may be practiced otherwise than as specifically described.

What is claimed is:

1. Apparatus for receiving and releasing a plurality of articles that may be of nonuniform dimensions, comprising:

a bin having at least four walls and open at its top and bottom;

first retaining means disposed within said bin for retaining any articles provided to said bin;

sensing means for sensing whether the location in said bin of the top of said first retaining means or of any articles retained thereby exceeds a predetermined level;

first moving means, connected to said first retaining means and responsive to said sensing means, for moving said first retaining means within said bin when the predetermined level is exceeded, to remove the excess over the predetermined level;

second, flexible retaining means removably disposed at the bottom of said bin for releasably closing off the bottom of said bin below said first retaining means; and second moving means connected to said bin and to said second retaining means for removing said second retaining means from, and replacing said second retaining means at the bottom of said bin, wherein said first moving means is located outside of said bin;

wherein a first said wall of said bin has a first opening through which part of said first retaining means extends for said connection to said first moving means;

wherein said first retaining means is provided with at least one groove;

and wherein said first wall is provided with a second opening connected to said first opening and having at least one projection configured to enter said at least one groove.

2. Apparatus as defined in claim 1 wherein:

said second opening is configured to permit said first retaining means to pass therethrough;

said first retaining means is provided with a plurality of grooves; and said second opening is provided with a plurality of projections configured to be respectively accommodated by said grooves, whereby said first retaining means can pass through said second opening unrestricted while said projections help to retain any articles resting on said first retaining means.

3. Apparatus as defined in claim 2, further comprising:

third moving means connected to said bin for moving said bin away from said first retaining means;

whereby said bin can be moved to a position over a container;

said container having a bottom and at least four walls and open at its top.

4. Apparatus as defined in claim 1 wherein:

said part of said first retaining means comprises a projection projecting from the rest of said first retaining means;

said connection between said first moving means and said first retaining means is at said projection of said first retaining means; and said first opening is configured to permit said projection of said first retaining means to extend therethrough while said first retaining means is being moved by said first moving means as well as while said first retaining means is stationary.

5. Apparatus as defined in claim 1 wherein:

said second, flexible retaining means comprises a plurality of rows of rollers, each of said rows comprising a plurality of rollers rotatably disposed on a rigid rod.

6. Apparatus as defined in claim 1 wherein said withdrawn position of said second, flexible retaining means is at least in part adjacent to and substantially parallel to a first wall of said bin.

7. Apparatus as defined in claim 1 wherein:

said second opening is configured to permit said first retaining means to pass through said second opening; and said apparatus further comprises third moving means connected to said bin for moving said bin away from said first retaining means.

8. Apparatus as defined in claim 1, further comprising:

third moving means connected to said bin for moving said bin away from said first retaining means;

whereby said bin can be moved to a position over a container;

said container having a bottom and at least four walls and open at its top.

9. Apparatus as defined in claim 1, further comprising first and second guides, wherein said first guide is connected to said first wall of said bin adjacent the bottom of said bin and extends therefrom a second wall, and said second guide is connected to a third wall of said bin adjacent the bottom of said bin and extends therefrom adjacent said second wall;

wherein said second, flexible retaining means slideably engages said bin at said first and second guides;

whereby said second, flexible retaining means is guided by said guides to be moved by said second moving means between a withdrawn position adjacent said second wall and outside said bin, and an extended position closing off the bottom of said bin below said first remaining means.

10. Apparatus as defined in claim 1 wherein each of said at least four walls of said bin is connected to at least two others of said at least four walls.

11. Apparatus for receiving and releasing a plurality of generally flat articles that may be of nonuniform dimensions, comprising:

a first container having at least four walls and open at its top and bottom;

a plate configured to be at least partially disposable within said first container, wherein said first container is provided with an opening in one of its at least four walls through which a portion of said plate can extend;

a roller bed slidably connected to first and second opposite walls of said first container and movable between an extended position covering the bottom of said first container below said plate, and a withdrawn position leaving the bottom of said first container uncovered;

a sensor for sensing whether the location in said first container of the top of said plate or of any articles disposed on said plate exceeds a predetermined level;

first moving means, connected to said plate and responsive to said sensor, for moving said plate within said first container when the predetermined level is exceeded, to remove the excess over the predetermined level, and second moving means, connected to said first container and to said roller bed, for moving said roller bed between said extended position closing off the bottom of said first container and said withdrawn position, wherein said roller bed comprises a plurality or rows of rollers arranged such that a plurality of colinearly arranged gaps is present in said roller bed;

wherein said roller bed is movable between said extended position and said withdrawn position past the bottom of a third wall of said first container;

and wherein the bottom of said third wall is provided with a plurality of projections configured to be respectively accommodated by said gaps of said roller bed, whereby said projections permit said roller bed to pass said projections unrestricted while helping to retain any articles resting on said roller bed.

12. Apparatus as defined in claim 11, further comprising first and second guides, wherein said first guide is connected to said first wall adjacent the bottom of said first container and extends therefrom along said third wall, and said second guide is connected to said second wall adjacent the bottom of said first container and extends therefrom adjacent said third wall;

wherein said roller bed slideably engages said first container at said first and second guides;

whereby said roller bed is guided by said guides to be moved by said second moving means between said withdrawn position adjacent said third wall and outside said first container, and said extended position.

13. Apparatus as defined in claim 11 wherein said withdrawn position of said roller bed is at least in part adjacent to and substantially parallel to said third wall of said first container.

14. Apparatus as defined in claim 13, further comprising first and second guides, wherein said first guide is connected to said first wall adjacent the bottom of said first container and extends therefrom along said third wall, and said second guide is connected to said second wall adjacent the bottom of said first container and extends therefrom adjacent said third wall;

wherein said roller bed slideably engages said first container at said first and second guides;

whereby said roller bed is guided by said guides to be moved by said second moving means between said withdrawn position adjacent said third wall and outside said first container, and said extended position.

15. Apparatus as defined in claim 11 wherein each of said at least four walls of said first container is connected to at least two others of said at least four walls.

16. Apparatus for receiving and releasing a plurality of generally flat articles that may be of nonuniform dimensions, comprising:

a first container having at least four walls and open at its top and bottom;

a plate configured to be at least partially disposable within said first container, wherein said first container is provided with an opening in one of its at least four walls through which a portion of said plate can extend;

a roller bed slidably connected to first and second opposite walls of said first container and movable between an extended position covering the bottom of said first container below said plate, and a withdrawn position leaving the bottom of said first container uncovered;

a sensor for sensing whether the location in said first container of the top of said plate or of any articles disposed on said plate exceeds a predetermined level;

first moving means, connected to said plate and responsive to said sensor, for moving said plate within said first container when the predetermined level is exceeded, to remove the excess over the predetermined level; and second moving means, connected to said first container and to said roller bed, for moving said roller bed between said extended position closing off the bottom of said first container and said withdrawn position, wherein said opening includes a portion permitting said plate to pass therethrough;

wherein said plate is provided with a plurality of grooves;

and wherein said portion of said opening is provided with a plurality of projections configured to be respectively accommodated by said grooves, whereby said plate can pass through said portion of said opening unrestricted while said projections help to retain any articles resting on said plate.

17. Apparatus as defined in claim 16, further comprising:

third moving means connected to said first container for moving said first container away from said plate;

whereby said first container can be moved to a position over a second container;

said second container having a bottom and at least four walls and open at its top.

18. Apparatus for receiving and releasing a plurality of generally flat articles that may be of nonuniform dimensions, comprising:

a first container having at least four walls and open at its top and bottom;

a plate configured to be at least partially disposable within said first container, wherein said first container is provided with an opening in one of its at least four walls through which a portion of said plate can extend;

a roller bed slidably connected to first and second opposite walls of said first container and movable between an extended position covering the bottom of said first container below said plate, and a withdrawn position leaving the bottom of said first container uncovered;

a sensor for sensing whether the location in said first container of the top of said plate or of any articles disposed on said plate exceeds a predetermined level;

first moving means, connected to said plate and responsive to said sensor, for moving said plate within said first container when the predetermined level is exceeded, to remove the excess over the predetermined level; and second moving means, connected to said first container and to said roller bed, for moving said roller bed between said extended position closing off the bottom of said first container and said withdrawn position, wherein said portion of said plate comprises a projection projecting from the rest of said plate;

wherein said connection between said first moving means and said plate is at said projection of said plate;

and wherein said opening in said first container includes a portion configured to permit said projection of said plate to extend therethrough while said plate is being moved by said first moving means as well as while said plate is stationary.

19. Apparatus for receiving and releasing a plurality of generally flat articles that may be of nonuniform dimensions, comprising:

a first container having at least four walls and open at its top and bottom;

a plate configured to be at least partially disposable within said first container, wherein said first container is provided with an opening in one of its at least four walls through which a portion of said plate can extend, said opening including a portion permitting said plate to pass through said portion of said opening;

a roller bed slidably connected to first and second opposite walls of said first container and movable between an extended position covering the bottom of said first container below said plate, and a withdrawn position leaving the bottom of said first container uncovered;

a sensor for sensing whether the location in said first container of the top of said plate or of any articles disposed on said plate exceeds a predetermined level;

first moving means, connected to said plate and responsive to said sensor, for moving said plate within said first container when the predetermined level is exceeded, to remove the excess over the predetermined level;

second moving means, connected to said first container and to said roller bed, for moving said roller bed between said extended position closing off the bottom of said first container and said withdrawn position; and third moving means connected to said first container for moving said first container away from said plate.

20. Apparatus for receiving and releasing a plurality of generally flat articles that may be of nonuniform dimensions, comprising:

a first container having at least four walls and open at its top and bottom;

a plate configured to be at least partially disposable within said first container, wherein said first container is provided with an opening in one of its at least four walls through which a portion of said plate can extend;

a roller bed slidably connected to first and second opposite walls of said first container and movable between an extended position covering the bottom of said first container below said plate, and a withdrawn position leaving the bottom of said first container uncovered;

a sensor for sensing whether the location in said first container of the top of said plate or of any articles disposed on said plate exceeds a predetermined level;

first moving means, connected to said plate and responsive to said sensor, for moving said plate within said first container when the predetermined level is exceeded, to remove the excess over the predetermined level; and second moving means, connected to said first container and to said roller bed, for moving said roller bed between said extended position closing off the bottom of said first container and said withdrawn position, wherein said first moving means is located outside of said first container;

wherein said first wall of said first container is provided with said opening;

wherein said opening comprises a first opening portion through which said portion of said plate extends for said connection to said first moving means;

wherein said plate is provided with at least one groove;

and wherein said opening further comprises a second opening portion connected to said first opening portion, configured to permit said plate to pass therethrough, and having at least one projection configured to enter said at least one groove.

21. Apparatus as defined in claim 20 wherein:

said roller bed comprises a plurality of rows of rollers, each of said rows comprising a plurality of rollers rotatably disposed on a rigid rod.

22. Apparatus as defined in claim 20 wherein said withdrawn position of said roller bed is at least in part adjacent to and substantially parallel to a third wall of said first container.

23. Apparatus as defined in claim 20, further comprising first and second guides, wherein said first guide is connected to said first wall adjacent the bottom of said first container and extends therefrom along a third wall, and said second guide is connected to said second wall adjacent the bottom of said first container and extends therefrom adjacent said third wall;

wherein said roller bed slideably engages said first container at said first and second guides;

whereby said roller bed is guided by said guides to be moved by said second moving means between said withdrawn position adjacent said third wall and outside said first container, and said extended position.

24. Apparatus ad defined in claim 20, further comprising:

third moving means connected to said first container for moving said first container away from said plate;

whereby said first container can be moved to a position over a second container;

said second container having a bottom and at least four walls and open at its top.

25. A method for receiving and releasing a plurality of articles using an apparatus comprising a first container having at least four walls and open at its top and bottom, a rigid retainer disposed within the first container for retaining any articles provided to the first container, a sensor for sensing whether the location in the first container of the top of the rigid retainer or of any articles retained thereby exceeds a predetermined level, and a flexible retainer removably disposed at the bottom of the first container for releasably closing off the bottom of the first container below the rigid retainer, said method comprising the steps of:

providing one or more articles to the rigid retainer;

responsive to the sensor, moving the rigid retainer downward as articles are provided to the rigid retainer;

when the rigid retainer reaches a predetermined position with respect to the first container, moving the first container away from the rigid retainer so that the articles move onto the flexible retainer;

placing the first container above a second container having a bottom and at least four sides and open at its top; and removing the flexible retainer from the bottom of the first container so that the articles are provided to the second container.

26. A method as defined in claim 25, further comprising the steps of:

after said step of placing the first container above the second container, lifting the second container closer to the first container; and after said removing step, lowering the second container away from the first container.

27. A method as defined in claim 25, further comprising the steps of:

after said removing step, replacing the flexible retainer at the bottom of the first container; and returning the first container to the rigid retainer.

28. A method as defined in claim 27, further comprising the steps of:

after said step of placing the first container above the second container, lifting the second container closer to the first container; and after said removing step, but before said replacing step, lowering the second container away from the first container.

29. A method as defined in claim 27, further comprising the step of:

after said returning step, moving the rigid retainer upward to a position adjacent the sensor.

30. A method as defined in claim 29, further comprising the steps of:

after said moving upward step, repeating said providing step, said moving downward step, said moving away step, said placing step, said removing step, said replacing step, said returning step and said moving upward step.

31. A method as defined in claim 29, further comprising the steps of:

after said step of placing the first container above the second container, lifting the second container closer to the first container; and after said removing step, but before said replacing step, lowering the second container away from the first container.

32. A method as defined in claim 31, further comprising the steps of:

after said moving upward step, repeating said providing step, said moving downward step, said moving away step, said placing step, said lifting step, said removing step, said lowering step, said replacing step, said returning step and said moving upward step.

33. Apparatus for receiving and releasing a plurality of articles that may be of nonuniform dimensions, comprising:

a bin having at least four walls and open at its top and bottom;

first retaining means disposed within said bin for retaining any articles provided to said bin;

sensing means for sensing whether the location in said bin of the top of said first retaining means or of any articles retained thereby exceeds a predetermined level;

first moving means, connected to said first retaining means and responsive to said sensing means, for moving said first retaining means within said bin when the predetermined level is exceeded, to remove the excess over the predetermined level;

second, flexible retaining means removably disposed at the bottom of said bin for releasably closing off the bottom of said bin below said first retaining means; and second moving means connected to said bin and to said second retaining means for removing said second retaining means from, and replacing said second retaining means at, the bottom of said bin, wherein said second, flexible retaining means comprises a plurality of rows of rollers arranged such that a plurality of colinearly arranged gaps is present in said second, flexible retaining means;

wherein said second, flexible retaining means is movable between an extended position and a withdrawn position past the bottom of a first wall of said bin;

and wherein the bottom of said first wall is provided with a plurality of projections configured to be respectively accommodated by said gaps of said second retaining means, whereby said projections permit said second retaining means to pass said projections unrestricted while helping to retain any articles resting on said second, flexible retaining means.

34. Apparatus as defined in claim 33 wherein each of said at least four walls of said bin is connected to at least two others of said at least four walls.

35. Apparatus as defined in claim 33, further comprising first and second guides, wherein said first guide is connected to a second wall of said bin adjacent the bottom of said bin and extends therefrom along said first wall, and said second guide is connected to a third wall of said bin adjacent the bottom of said bin and extends therefrom adjacent said first wall;

wherein said second, flexible retaining means slideably engages said bin at said first and second guides;

whereby said second, flexible retaining means is guided by said guides to be moved by said second moving means between said withdrawn position adjacent said first wall and outside said bin, and said extended position closing off the bottom of said bin below said first retaining means.

36. Apparatus as defined in claim 33 wherein said withdrawn position of said second, flexible retaining means is at least in part adjacent to and substantially parallel to said first wall of said bin.

37. Apparatus as defined in claim 36, further comprising first and second guides, wherein said first guide is connected to said first wall of said bin adjacent the bottom of said bin and extends therefrom along a second wall, and said second guide is connected to a third wall of said bin adjacent the bottom of said bin and extends therefrom adjacent said first wall;

wherein said second, flexible retaining means slideably engages said bin at said first and second guides;

whereby said second, flexible retaining means is guided by said guides to be moved by said second moving means between said withdrawn position adjacent said first wall and outside said bin, and said extended position closing off the bottom of said bin below said first retaining means.

38. Apparatus as defined in claim 3, further comprising first and second guides, wherein said first guide is connected to a first wall of said bin adjacent the bottom of said bin and extends therefrom along a second wall, and said second guide is connected to a third wall of said bin adjacent the bottom of said bin and extends therefrom adjacent said second wall;

wherein said second, flexible retaining means slideably engages said bin at said first and second guides;

whereby said second, flexible retaining means is guided by said guides to be moved by said second moving means between a withdrawn position adjacent said second wall and outside said bin, and an extended position closing off the bottom of said bin below said first retaining means.

* * * * *